US010456887B2

(12) United States Patent
Bright et al.

(10) Patent No.: US 10,456,887 B2
(45) Date of Patent: Oct. 29, 2019

(54) VALVE GRINDING TOOL

(71) Applicants: Jeffery W. Bright, Jacksonville, FL (US); Roy McGriff, Ponte Vedra, FL (US)

(72) Inventors: Jeffery W. Bright, Jacksonville, FL (US); Roy McGriff, Ponte Vedra, FL (US)

(73) Assignee: JEFFRO, INC., Jacksonville, FL (US)

( * ) Notice: Subject to any disclaimer, the term of this patent is extended or adjusted under 35 U.S.C. 154(b) by 0 days.

(21) Appl. No.: 16/045,673

(22) Filed: Jul. 25, 2018

(65) Prior Publication Data

US 2019/0030680 A1 Jan. 31, 2019

Related U.S. Application Data

(60) Provisional application No. 62/536,941, filed on Jul. 25, 2017.

(51) Int. Cl.

| | |
|---|---|
| ***B24B 41/06*** | (2012.01) |
| ***B24B 7/16*** | (2006.01) |
| ***B24B 23/02*** | (2006.01) |

(52) U.S. Cl.

CPC ..... *B24B 41/067* (2013.01); *B24B 7/16* (2013.01); *B24B 23/02* (2013.01)

(58) Field of Classification Search

CPC ..... B24B 7/16; B24B 7/165; B24B 7/167; B24B 23/02; B24B 41/06; B24B 41/067

See application file for complete search history.

(56) References Cited

U.S. PATENT DOCUMENTS

| | | | | | |
|---|---|---|---|---|---|
| 2,956,380 | A * | 10/1960 | Yule | B24B 23/02 | 451/431 |
| 3,577,688 | A * | 5/1971 | Brenden | B24B 7/16 | 451/430 |
| 3,631,639 | A * | 1/1972 | Day | B24B 7/16 | 451/430 |
| 4,177,825 | A * | 12/1979 | Crawford | F16K 1/485 | 137/243.2 |
| 4,581,854 | A * | 4/1986 | Collopy | B24B 15/08 | 451/117 |
| 2016/0052105 | A1* | 2/2016 | Chen | B24B 47/16 | 451/388 |
| 2018/0161888 | A1* | 6/2018 | Abresch | B28D 1/188 | |

* cited by examiner

*Primary Examiner* — Timothy V Eley
(74) *Attorney, Agent, or Firm* — Mark Young, P.A.

(57) ABSTRACT

A tool includes a coupling, an inner adjustment sleeve, and an outer adjustment sleeve. The coupling connects a rotary tool to the inner adjustment sleeve. An adjustable portion of the inner adjustment sleeve is threadedly received in the outer adjustment sleeve. An offset aperture in the free end of the outer adjustment sleeve receives a tip of a valve stem for grinding. An optional cup at the end of the outer adjustment sleeve stabilizes the tool. A grinding bit with a shaft retained in a collet of the rotary tool is contained internally, in a channel, extending through the tool.

5 Claims, 21 Drawing Sheets

VALVE GRINDING TOOL

RELATED APPLICATION

This application is a nonprovisional and claims the benefit of priority of U.S. Provisional Patent Application No. 62/536,941, filed Jul. 25, 2017, the entire contents of which are incorporated herein and made a part hereof.

FIELD OF THE INVENTION

This invention relates generally to internal combustion engines, and, more particularly, to a tool for grinding tips of poppet valves for appropriate clearance.

BACKGROUND

During a typical valve job, valve seats of the cylinder heads are resurfaced. Some cylinder heads have integral valve seats, while others have replaceable hardened steel valve seats. Replaceable valve seats can be removed and replaced. Integral seats are typically milled to allow the insert of a new seat. After resurfacing valve seats, the distance from the valve seat to the opposite side of the cylinder head may have decreased, which affects valve lash.

Valve lash or valve clearance is the gap between the rocker arms or bucket followers and the valve tip. In engines with rocker arms, a threaded rod or an eccentric at the end of each rocker arm adjusts the clearance to the top of the valve. In engines with overhead cams, bucket followers with calibrated shims, either above or below the buckets, are used to define the clearance. This clearance must be tightly controlled—too little and the valves may not seat properly, too much creates valve train noise and excess load on the valves and valve train components.

Often, after resurfacing valve seats and installing new valves, shims must be used to ensure proper height and clearance. As shims vary considerably in dimensions and configuration, and vary among corresponding followers, machinists must frequently order shims as needed. Maintaining an inventory of shims is impractical for many machinists. Ordering consumes time, which, means delayed job completion and delayed payment.

What is needed is a tool to precisely grind the tip of valves to provide proper clearance. The tool should be relatively inexpensive, easy to use and produce a tip with a planar top ground to a desired relative height.

The invention is directed to overcoming one or more of the problems and solving one or more of the needs as set forth above.

SUMMARY OF THE INVENTION

To solve one or more of the problems set forth above, in an exemplary implementation of the invention, a valve tip grinding tool includes a coupling, an inner adjustment sleeve (aka, threaded sleeve), a lock (jam) nut, and an outer adjustment sleeve (aka, alignment tube). The coupling connects a rotary tool to the inner adjustment sleeve. At least a portion of the inner adjustment sleeve is threadedly received in the outer adjustment sleeve. The extent received defines the length of the tool, which defines the depth of grinding. The free end of the outer adjustment sleeve includes an offset (not centered) aperture in which a tip of a valve stem is received for grinding. The aperture may be formed in an integral end of the outer adjustment sleeve or in an insert or cap that is removably attachable to the outer adjustment sleeve. A grinding disk is connected to a shaft or shank, which is retained in a collet of the rotary tool. The disk and shaft are contained internally, in a channel, extending through the tool.

In one embodiment, a spring cup is provided at the end of the outer adjustment sleeve. The spring cup receives a portion of a valve assembly. A tight fit between the cup and received portion of the valve assembly limits play. This helps ensure level planar grinding of the tip of the valve stem.

In some embodiment means for catching shavings are provided. Such means may include a cup-like structure formed in an interior channel of the tool and/or one or more magnets that extend into the interior channel of the tool adjacent to the grinding disk.

A valve grinding tool includes a coupler, a threaded sleeve and an alignment tube. The coupler includes a first end, a second end and a coupler central channel extending from the first end of the coupler to the second end of the coupler. The first end of the coupler is open and includes internal threads for connecting to a rotary tool (e.g., to a threaded collar of such a tool). The second end of the coupler is open and opposite to the first end of the coupler.

The alignment tube includes a first end, a second end and an alignment tube channel extending from the first end of the alignment tube to the second end of the alignment tube. The alignment tube has a central alignment tube longitudinal axis. The first end of the alignment tube is open and includes internal threads for connecting to the threaded sleeve. The second end of the alignment tube has an opening.

The threaded sleeve includes a central channel. The threaded sleeve couples the second end of the coupler to the first end of the alignment tube. A distance between the second end of the coupler and the first end of the alignment tube is adjustable by threadedly receiving a portion of the threaded sleeve in the central channel of the coupler and/or in the channel of the alignment tube. The central channel of the threaded sleeve has a central longitudinal axis.

The opening of the second end of the alignment tube has a center. The central longitudinal axis of the alignment tube threaded sleeve is not aligned with the center of the opening of the second end of the alignment tube. The opening of the second end of the alignment tube and the central channel of the alignment tube are sized to receive an end of a stem of a valve to be ground. The coupler central channel and alignment tube channel are sized to receive a grinding disk attached to a shank.

In this embodiment, the valve grinding tool is separate from the valve and from the stem of a valve to be ground. Also, in this embodiment, the valve grinding tool is separate from the grinding disk attached to the shank. Additionally, in this embodiment, the valve grinding tool is separate from the rotary tool.

Optionally, a lock nut may be provided on the threaded sleeve.

Markings (e.g., indicia) may be provided to indicate the length of the tool and/or the extend (e.g., depth) of grinding. For example, the valve grinding tool may have a first indicium on the threaded sleeve adjacent to the alignment tube, and a second indicium on the alignment tube adjacent to the threaded sleeve. When the first indicium is aligned with the second indicium, the first end of the alignment tube is a first (e.g., known) distance from the second end of the coupler. Many such indicia may be provided to indicate various lengths or depths.

In one embodiment, the second end of the alignment tube includes a cover in which the opening of the second end of the alignment tube is formed as an aperture. The central alignment tube longitudinal axis is not aligned with the center of the opening of the second end of the alignment tube.

In another embodiment, the alignment tube channel includes a first portion and a second portion. The first portion extends from the first end of the alignment tube and has a first central longitudinal axis. The second portion extends from the second end of the alignment tube to the first portion of the alignment tube channel and has a second central longitudinal axis. The first central longitudinal axis is not aligned with the second central longitudinal axis.

In another embodiment, the alignment tube magnetically retains grindings. For example, at least one magnet may be attached to the alignment tube. Alternatively, the alignment tube may be comprised of a magnetized ferromagnetic material.

In another embodiment, an optional spring cup extends from the second end of the alignment tube. The spring cup engulfs the exposed portion of a valve spring.

In another embodiment, the outer diameter of the alignment tube is less (e.g., slightly less [no more than 2% less]) than an inner diameter of a cup-shaped cam follower to be ground. In this embodiment, the disc of the grinding tool is positioned near the second end of the alignment tube and the cam follower cup may be slid onto the end of the alignment tube. Thus, in this embodiment, the portion of the cam follower cup that extends into the alignment tube may be ground level.

In another embodiment, a rotary tool and grinding disk assembly are included to provided a valve grinding system. The rotary tool includes a motor, threaded collar and a chuck coupled to the motor. The grinding disk assembly includes an abrasive disk attached to a shank. The shank is retained in the chuck of the rotary tool. The alignment tube channel is sized to receive the abrasive disk attached to the shank of the grinding disk assembly.

BRIEF DESCRIPTION OF THE DRAWINGS

The foregoing and other aspects, objects, features and advantages of the invention will become better understood with reference to the following description, appended claims, and accompanying drawings, where:

DETAILED DESCRIPTION

Figure 12:
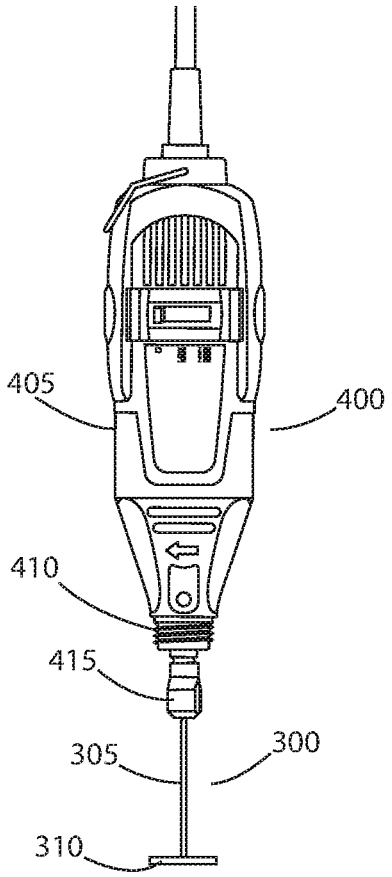
FIG. 12 is a front view of an exemplary rotary tool with an abrasive grinding bit for use with a valve tip grinding tool according to principles of the invention.

With reference to FIGS. 1 through 6, an exemplary valve grinding tool 100 according to principles of the invention includes a coupling 105, an inner adjustment sleeve 120, a lock nut 115, and an outer adjustment sleeve 130. The coupling 105 is a sleeve (i.e., a structure with a central cylindrical channel 112 extending from end 110 to end 114). One end 110 of the coupling 105 receives and threadedly engages a threaded nose 410 of a rotary tool 400 (FIG. 12). The opposite end 114 of the coupling 105 receives and threadedly engages an end 113 of the inner adjustment sleeve 120. Thus, the function of the coupling 105 is to couple a rotary tool 400 to the inner adjustment sleeve 120.

Figure 5:
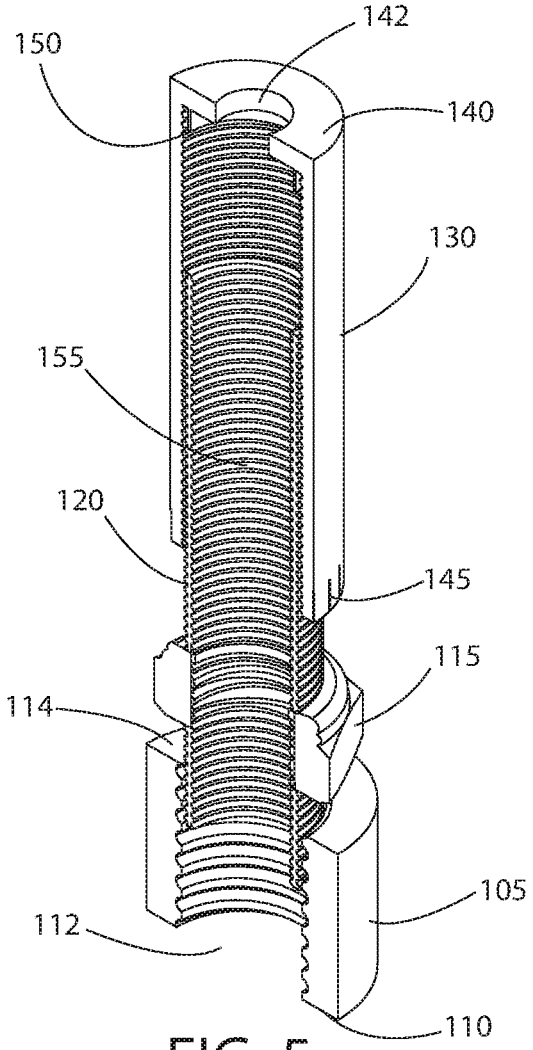
FIG. 5 is a bottom perspective section view of an exemplary valve tip grinding tool according to principles of the invention.
Figure 6:
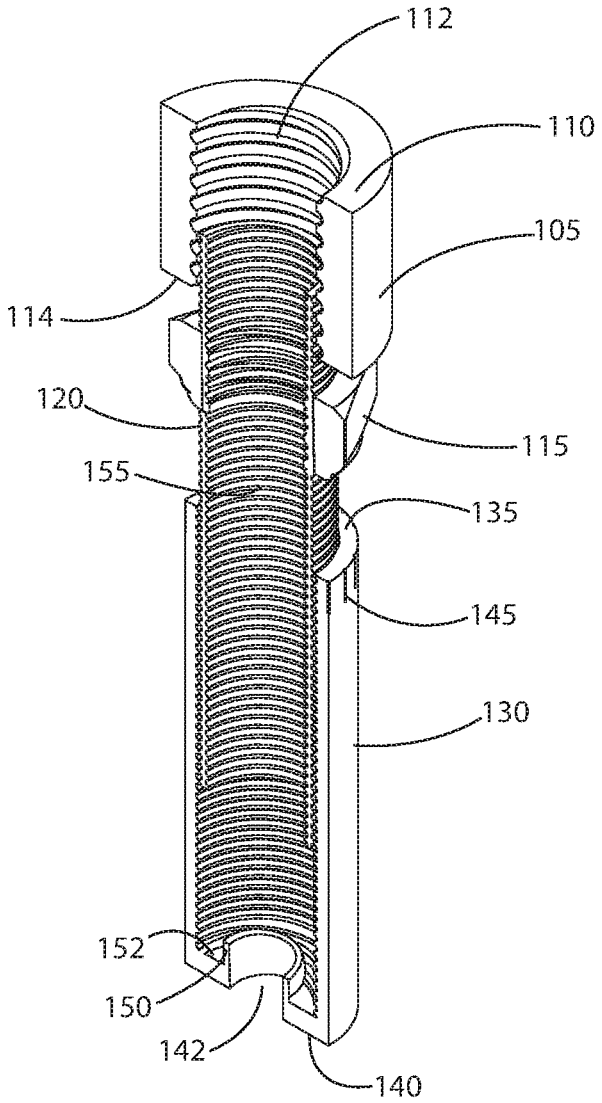
FIG. 6 is a top perspective section view of an exemplary valve tip grinding tool according to principles of the invention.

The inner adjustment sleeve 120 of the exemplary tool 100 is a sleeve with external threads. A central channel 155 extends through the sleeve 120. The inner surface of the channel 155 may be smooth or threaded, as shown in FIGS. 5 and 6. However, inner threads are not necessary unless another component is configured with an externally threaded male component that is received within and threadedly mates with the inner adjustment sleeve 120.

An outer adjustment sleeve 130 extends from the inner adjustment sleeve 120, opposite to the coupling 105. The outer adjustment sleeve 130 is a sleeve with a central channel and internal threads that mate with the external threads of the inner adjustment sleeve 120. One end 135 of the outer adjustment sleeve 130 is open, and receives and threadedly engages an end of the inner adjustment sleeve 120. In the embodiment shown in FIGS. 1 through 6, the opposite end includes a cover 140 with a circular cross section aperture 142 (shown in FIGS. 4 through 6) sized to receive a tip of a valve stem to be resurfaced (i.e., ground).

Figure 1:
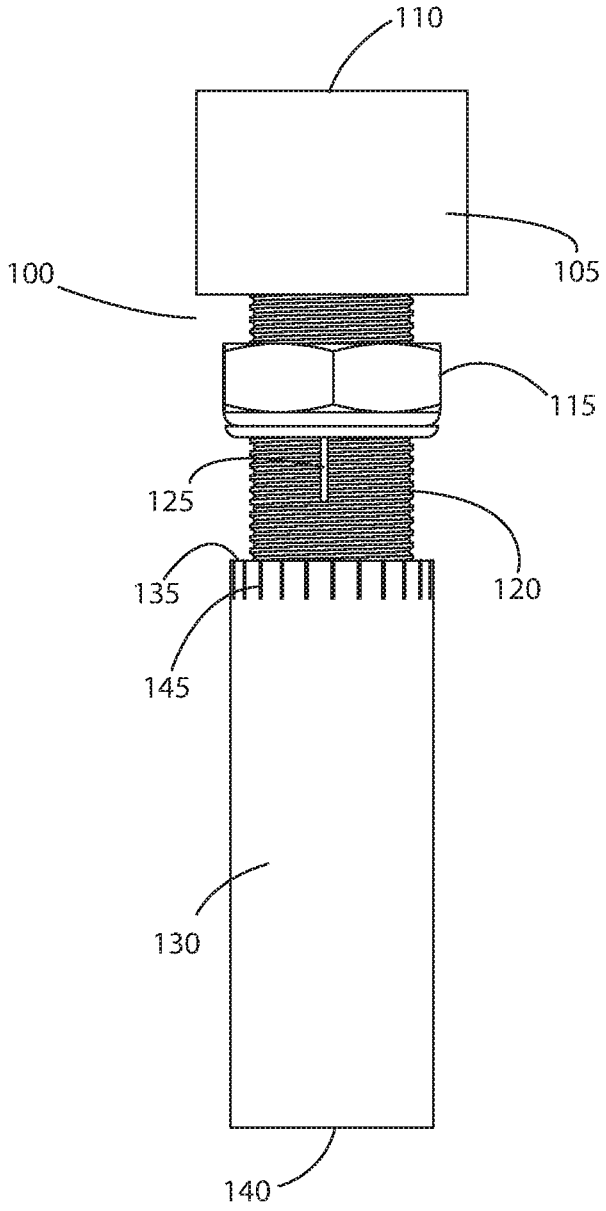
FIG. 1 is a front view of an exemplary valve tip grinding tool according to principles of the invention.
Figure 2:
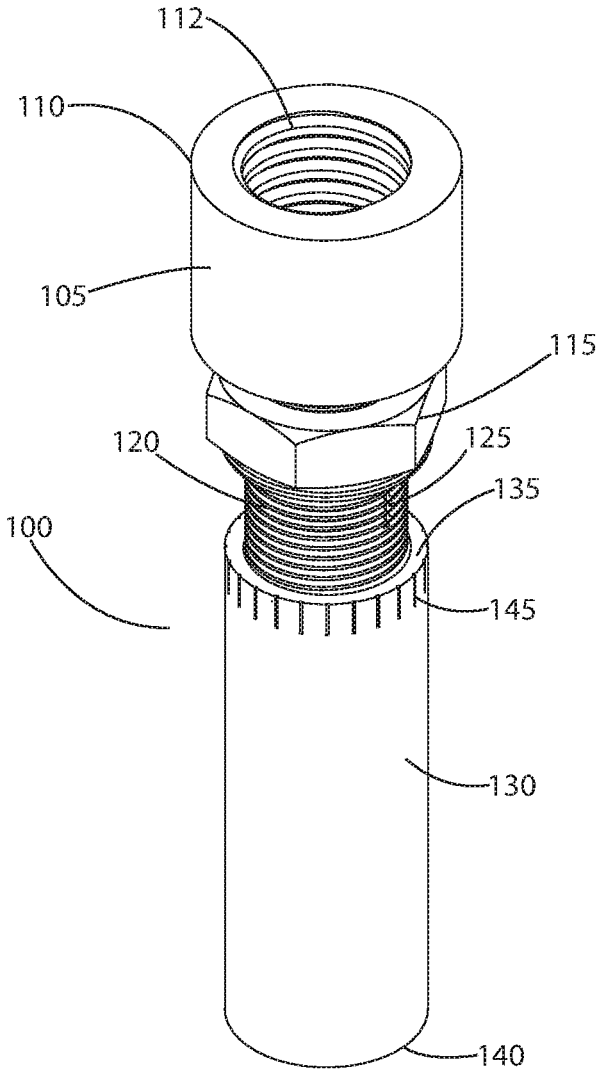
FIG. 2 is a top perspective view of an exemplary valve tip grinding tool according to principles of the invention.
Figure 3:
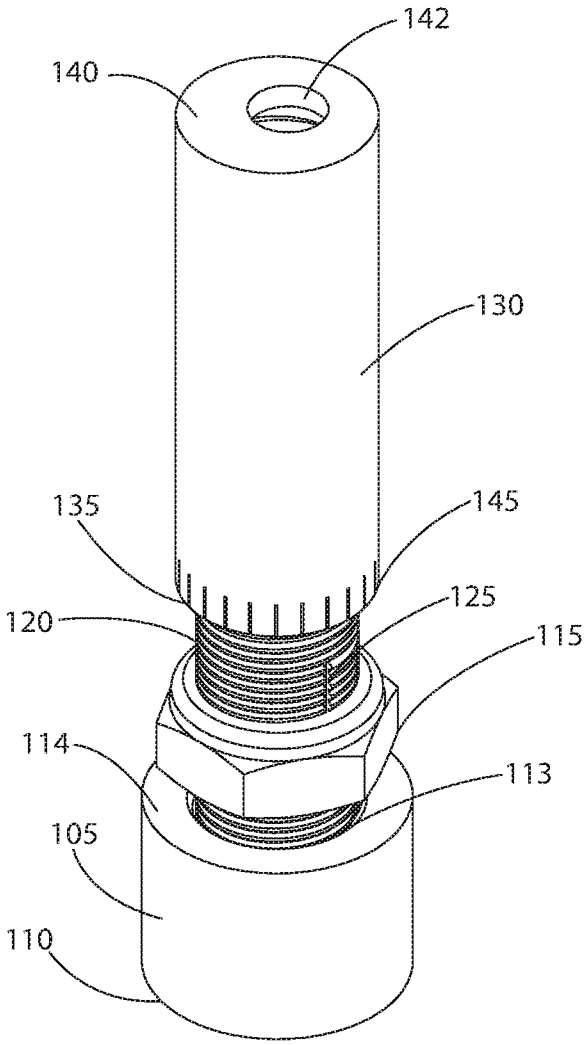
FIG. 3 is a bottom perspective view of an exemplary valve tip grinding tool according to principles of the invention.
Figure 4:
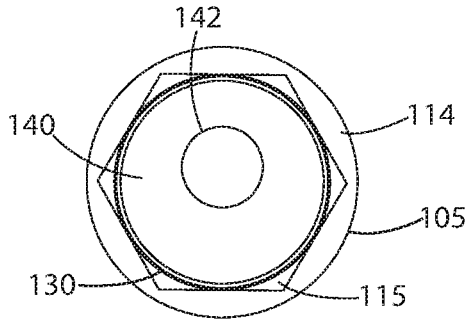
FIG. 4 is a bottom view of an exemplary valve tip grinding tool according to principles of the invention.

As evident in FIGS. 3 and 4, the aperture 142 in the cover 140 of the outer adjustment sleeve 130 is off-center, meaning that its center is not aligned with the center of the outer adjustment sleeve 130. This off-center configuration facilitates grinding. During use, a rotating grinding disk is contained within the outer adjustment sleeve 130 near the cover 140. Grinding proceeds more effectively when the surface being ground is positioned away from the center of the disk, towards the peripheral edge of the disk. The cross-radial (tangential) velocity (v) of the surface of the disk grinding the tip of valve increases with distance from the center, r, and with rotational velocity, ω, as in $v=r\omega$. The aperture 142 is positioned off-center relative to the center of the outer adjustment sleeve 130 to ensure effective grinding of the tip of the valve stem, by providing a non-zero tangential velocity. By way of example and not limitation, given a radius, $r_o$, of the outer adjustment sleeve 130, the center of the aperture 142 is positioned at $a \times r_o$, where $0<a<1$, and more preferably $0.1<a<0.7$, and even more preferably $0.2<a<0.5$.

A jam nut 115 is provided on the inner adjustment sleeve 120. It is used as a lock nut. When tightened (jammed) against the outer adjustment sleeve 130, the jam nut 115 prevents unintended rotation and motion of the outer adjustment sleeve 130 relative to the inner adjustment sleeve 120. While a nut with polygonal (e.g., hexagonal) periphery is shown, other nut-like members, including knurled nuts may be used in addition to, or in lieu of, the depicted jam nut 115. Additionally, more than one jam nut may be provided for the outer adjustment sleeve 130 and the coupling 105.

The pitch of the threads on the inner adjustment sleeve is x threads per inch. One revolution of the outer adjustment sleeve relative to the inner adjustment sleeve advances the outer adjustment sleeve toward or away from the coupling precisely 1/x". Markings 145 on the edge of the outer adjustment sleeve indicate partial rotations relative to a marking 125 on the inner adjustment sleeve, for fine adjustment. By way of example and not limitation, the reading lines 145 may be divided into y equal parts (e.g., 360°/y) that correspond to the number of increments in a full rotation. Therefore, each reading line may indicate indicates 1/(x×y)" relative movement. Illustratively, if, by way of example, x is 10 (i.e., there are 10 threads per inch) and there are 36 markings 145, i.e., one marking every 10°, then a rotation of one marking is 1/36 of a full rotation, which corresponds to 1/360 inches, or 0.00278 inches.

As stray metal particles in a valve assembly or cylinder head could interfere with valve movement and seating and accelerate wear, collecting particles is desirable. As most clearly evident in the section view of FIG. 6, a collection cup 152 may be formed in the interior of the outer adjustment sleeve 130. The collection cup 152 surrounds the aperture 142. The collection cup 152 is a bundt pan shaped container, with the central opening being the aperture 142. The collection cup is defined by a raised cylindrical wall 150 extending inwardly from the aperture 142. The aperture 142 and cylindrical wall 150 have the same or nearly the same radius. The base and outer wall of the bundt pan shaped container are defined by the cover 140 and the outer adjustment sleeve 130. During use, metal particles ground from a valve tip collect in the collection cup 152. The collected particles will therefore not fall into the valve assembly or cylinder head.

Figure 7:
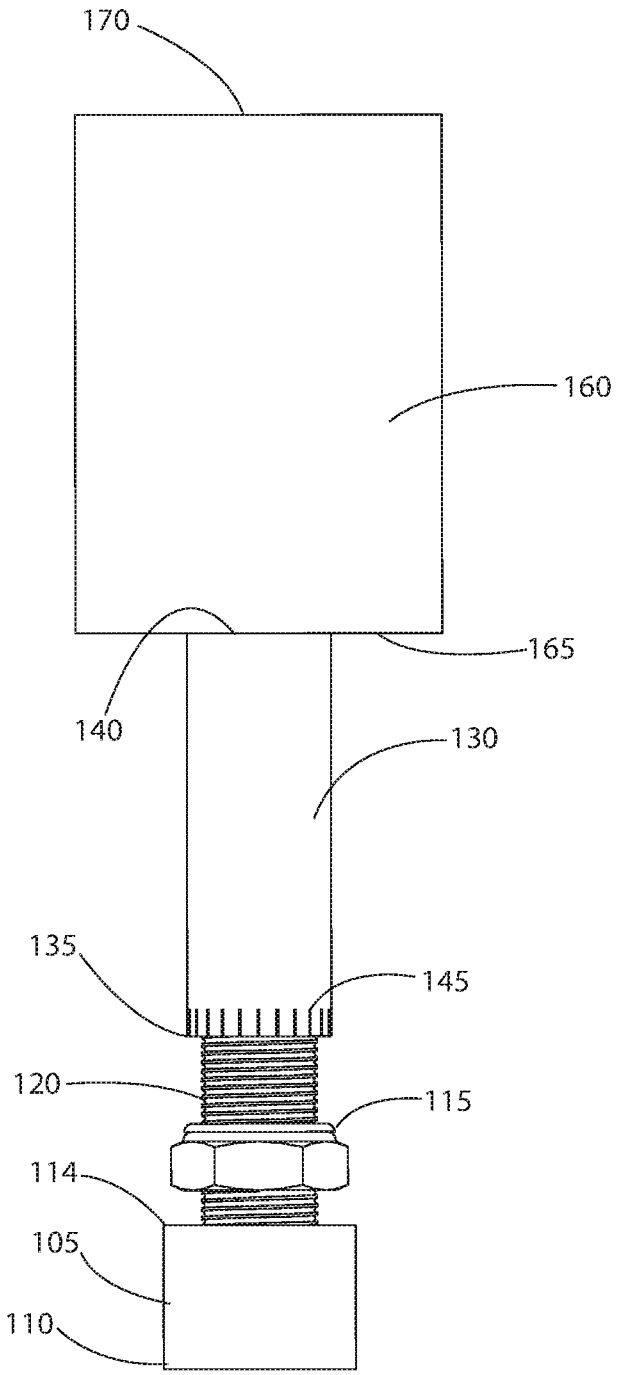
FIG. 7 is a front inverted view of another exemplary valve tip grinding tool according to principles of the invention.
Figure 8:
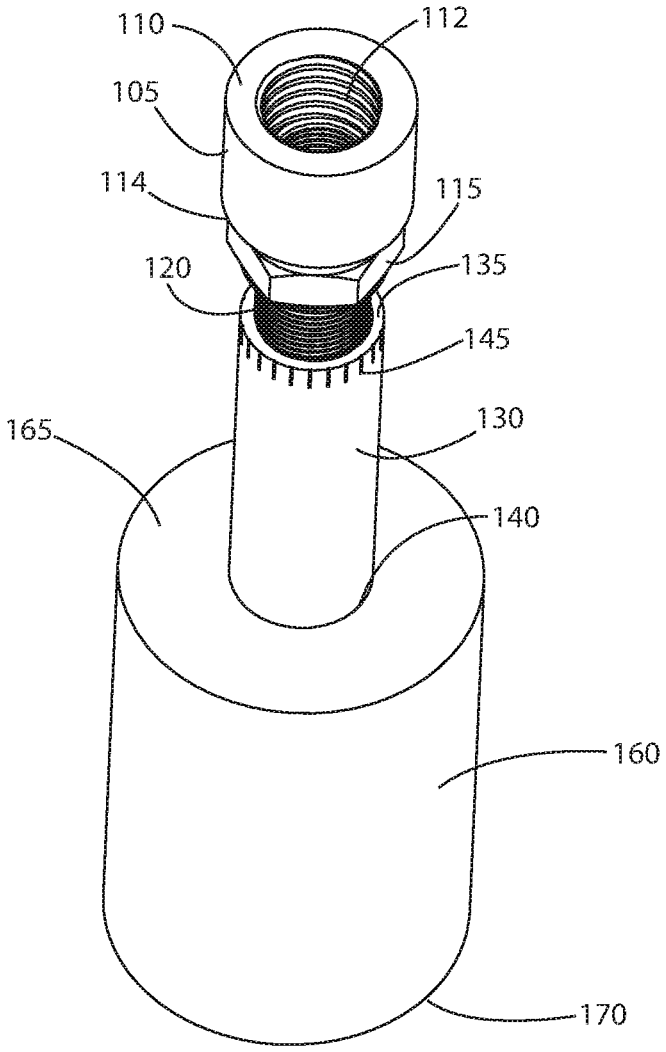
FIG. 8 is a top perspective view of the exemplary valve tip grinding tool of FIG. 7.
Figure 9:
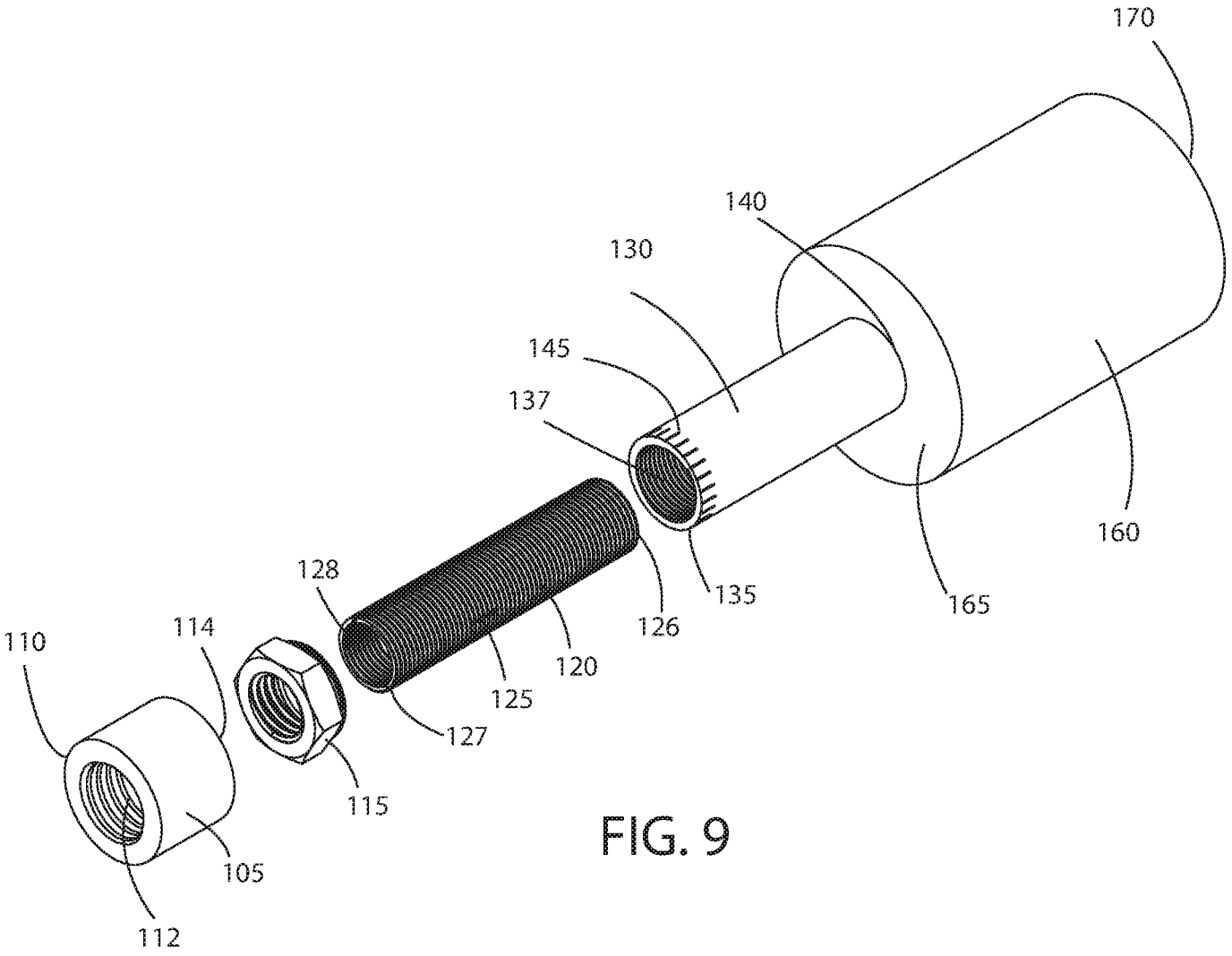
FIG. 9 is an exploded perspective view of the exemplary valve tip grinding tool of FIG. 7.

FIGS. 7 through 9 illustrate an embodiment of the tool 100 with a spring cup 160. One end 165 (i.e., a covered end) of the cup 160 attaches to an end 140 of the outer adjustment sleeve 130. The opposite end 170 of the cup 160 is open. The diameter of the cup 160 is slightly larger than the diameter of a valve assembly, as described below. The depth (length) of the cup is sufficient to receive the valve assembly to about a spring seat, as described below. In this embodiment, the cover 140, aperture 142, collection cup 152, and cylindrical wall 150 are not necessary.

To maintain the off-center relationship discussed above, the center (a longitudinal axis extending through the center) of the outer adjustment sleeve 130 is not aligned with the center (a longitudinal axis extending through the center) of the cup 160. The tip of a valve stem will extend into the cup parallel to and in alignment with a longitudinal axis extending through the center of the cup 160. The tip is preferably not aligned with the center (a longitudinal axis extending through the center) of the outer adjustment sleeve 130. By way of example and not limitation, given a radius, $r_o$, of the outer adjustment sleeve 130, the center of the cup 160 is positioned at $a \times r_o$, where $0<a<1$, and more preferably $0.1<a<0.7$, and even more preferably $0.2<a<0.5$.

Figure 10:
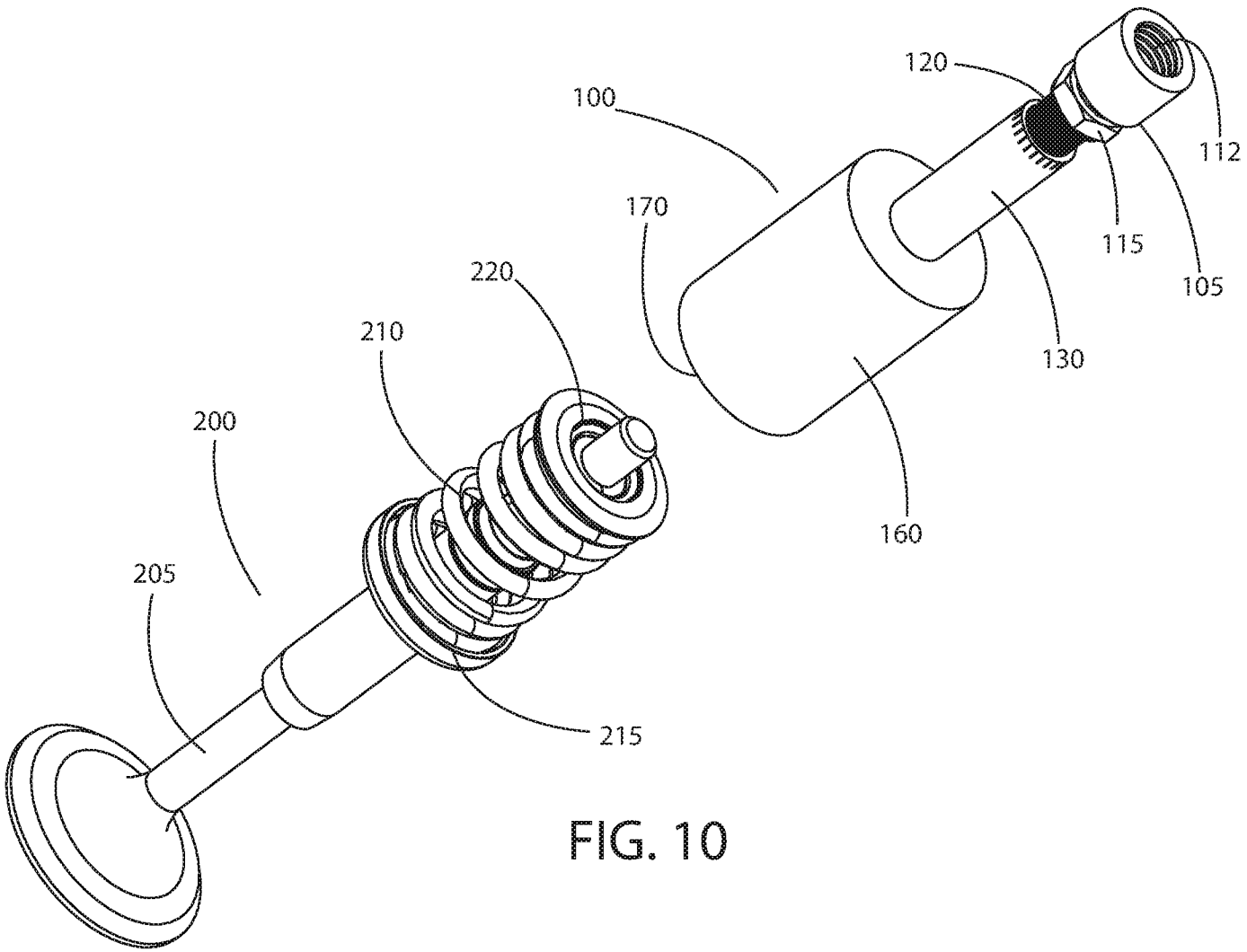
FIG. 10 is a top perspective view of the exemplary valve tip grinding tool of FIG. 7 with a valve assembly according to principles of the invention.
Figure 11:
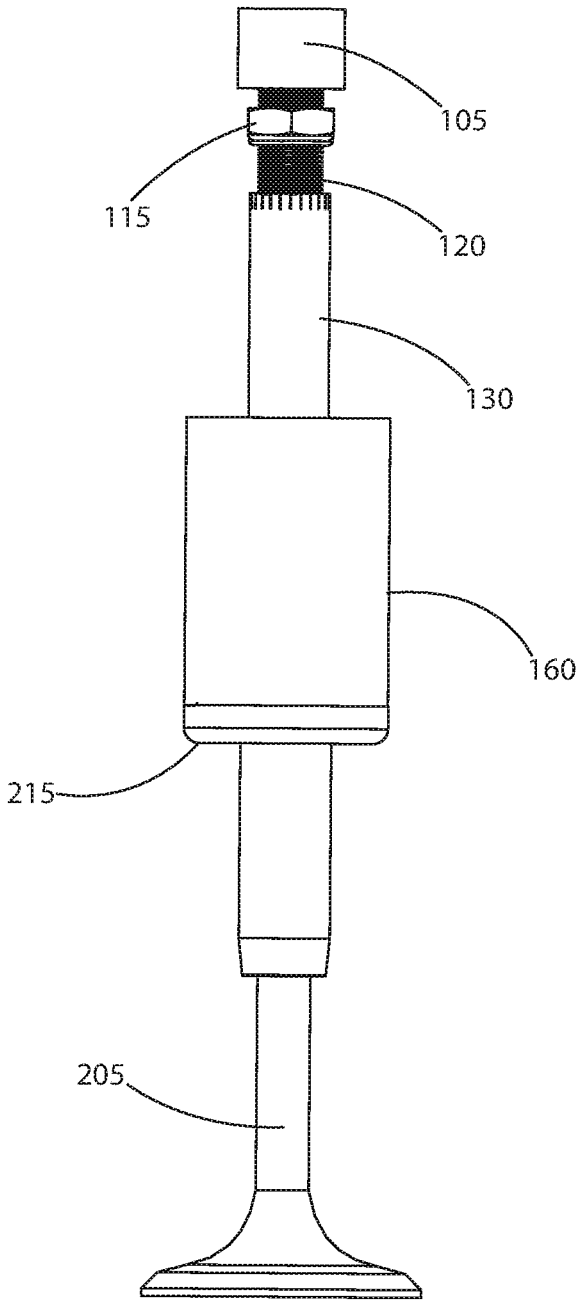
FIG. 11 is a front view of the exemplary valve tip grinding tool of FIG. 7 positioned on a valve assembly according to principles of the invention.

FIGS. 10 and 11 illustrate the exemplary valve tip grinding tool of FIG. 7 with a valve assembly according to principles of the invention. The valve assembly 200 includes a poppet valve 205 with a valve stem and a tip 225 to be ground, and a spring 210 between a spring seat 215 and retainer 220. The cup 160 is sized to slide over the top of the assembly up to about the spring seat 215, as conceptually illustrated in FIG. 11. The spring 210, retainer 220 and tip 225 are received in the cup 160. The tip 225 is received up to about the inside of the covered end 165. A grinding disk extends into the cup between the tip 225 and the inside of the covered end 165. As the inner diameter of the cavity of the cup 160 is only slightly larger than the spring 210 diameter, the fit provides very little room for play. Thus, the cup 160 prevents undesirable tilting of the tool 100 during use.

FIG. 12 is a front view of an exemplary rotary tool 400 with an abrasive grinding bit 300 for use with a valve tip grinding tool 100 according to principles of the invention. The grinding bit includes a shaft 305 or shank and a cylindrical cross section disk 310 with an abrasive grinding surface. The shaft 305 is secured in a collet (i.e., a chuck that forms a collar around the shaft and exerts a strong clamping force on the shaft when it is tightened) of the rotary tool 400. The rotary tool 400 includes a housing 405 with a threaded nose 410. In some rotary tools, a removable ring-like threaded cover is provided on the nose 410. Any such ring-like threaded cover must be removed to expose the threaded nose 410.

Figure 13:
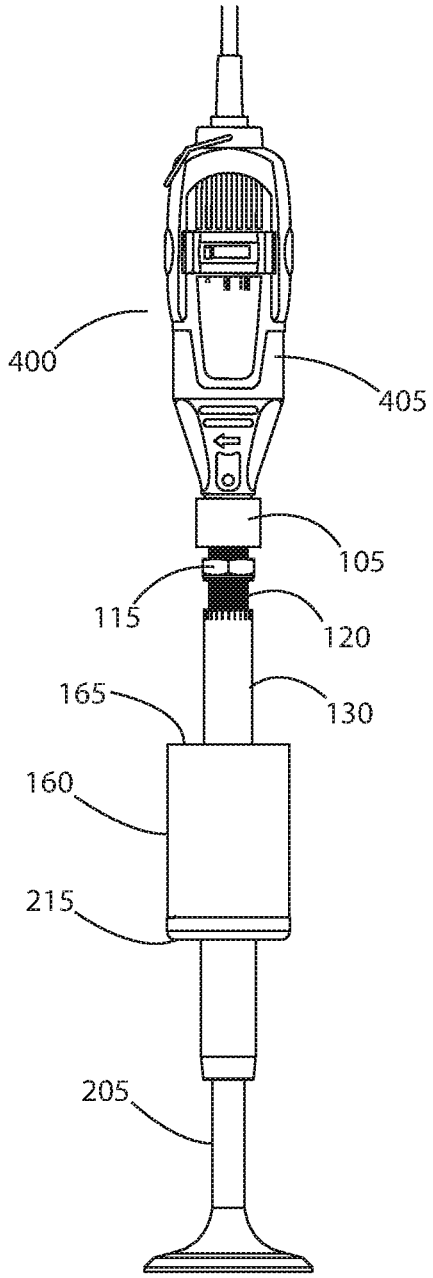
FIG. 13 is a front view of the exemplary valve tip grinding tool of FIG. 7 positioned on a valve assembly, with a rotary tool, according to principles of the invention.

As shown in FIG. 13, the threaded nose 410 of the rotary tool 400 threads into the coupling 105. The cup 160 slides over the top of a valve assembly 200 up to about the spring seat 215. The spring 210, retainer 220 and tip 225 are received in the cup 160. The tip 225 is received up to about the inside of the covered end 165. A grinding disk 310 extends into the cup 160 between the valve tip 225 and the inside of the covered end 165. As the inner diameter of the cavity of the cup 160 is only slightly larger than the spring 210 diameter, the fit provides very little room for play. Thus, the cup 160 prevents undesirable tilting of the tool 100 during use.

To adjust the depth of grinding, the outer adjustment sleeve 130 may be rotated relative to the inner adjustment sleeve 120, with rotation in one direction decreasing the distance between the coupling 105 and cup 160, and therefore increasing the depth of grinding, and rotation in the opposite direction increasing the distance between the coupling 105 and cup 160, and therefore decreasing the depth of grinding. The depth may be carefully calibrated using the markings 125, 145, as discussed above.

Grinding may proceed until the tool 100 bottoms out on a surface of the valve assembly 200. By way of example, the cup 160 may bottom out on a spring seat 215. Alternatively, in the embodiment of FIG. 1, the bottom 140 of the outer adjustment tube 130 may bottom out against the spring retainer 220 of the valve assembly 200.

Figure 14:
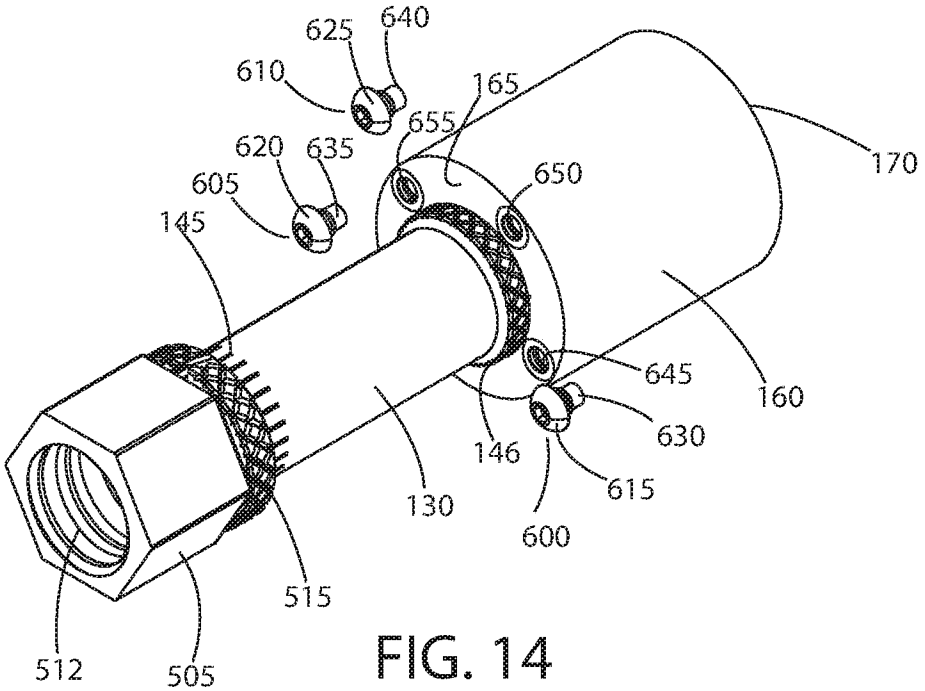
FIG. 14 is a perspective view of another exemplary valve tip grinding tool with removable magnetic shaving catchers according to principles of the invention.

FIG. 14 is a perspective view of another exemplary valve tip grinding tool 100 with removable magnetic shaving catchers according to principles of the invention. The magnetic shaving catchers comprise screws 600, 605, 610, each having a screw head 615, 620, 625 and a threaded shank that terminates with a magnet at the free end of the shank 630, 635, 640. While three screws and corresponding threaded holes are illustrated in the perspective view of FIG. 14, the invention is not limited to any number of such screws and holes. Rather, such screws are optional. An embodiment of the invention may include zero, one or more such screws and corresponding holes. The screws threaded into corresponding threaded holes 645, 650, 655 in the top of the cup 160. However, they may be configured to thread into other areas (e.g., the sidewall) of the cup 160 without departing from the scope of the invention. The magnets catch (i.e., magnetically attract and hold) metal shavings (typically steel shavings) propelled during grinding action. Each magnet is preferably a permanent magnet, made from a material that is magnetized and creates its own persistent magnetic field. In an exemplary embodiment, the magnet is a ceramic, or ferrite, magnet made of a sintered composite of powdered iron oxide and barium/strontium carbonate ceramic; or an alnico magnet made by casting or sintering a combination of aluminum, nickel and cobalt with iron and other elements; or a rare-earth magnet, such as a samarium-cobalt or neodymium-iron-boron magnet. The magnet may be coated (e.g., nickel or zinc plated or epoxy coated) to enhance durability and corrosion resistance.

The embodiment of FIG. 14 also reveals a knurled jam nut 515, and a knurled threaded end 146 of the outer adjustment sleeve 130, to which the cup 160 is threadedly attached. Additionally, in FIG. 14, the inner adjustment sleeve 120 is substantially received within the outer adjustment sleeve 130, and therefore not apparent in the drawing.

Figure 15:
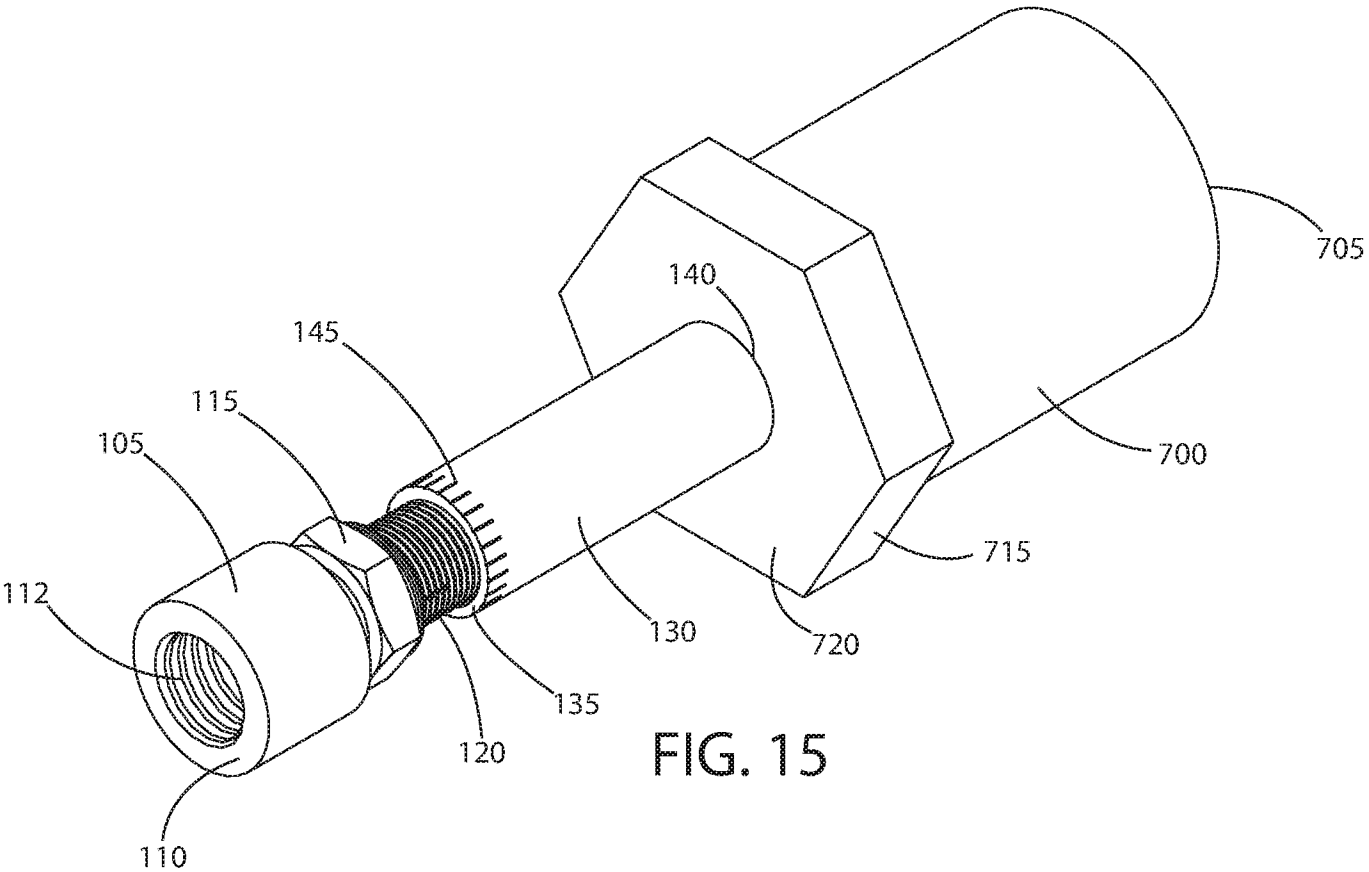
FIG. 15 is a perspective view of yet another exemplary valve tip grinding tool with removable cap on the spring cup according to principles of the invention.
Figure 16:
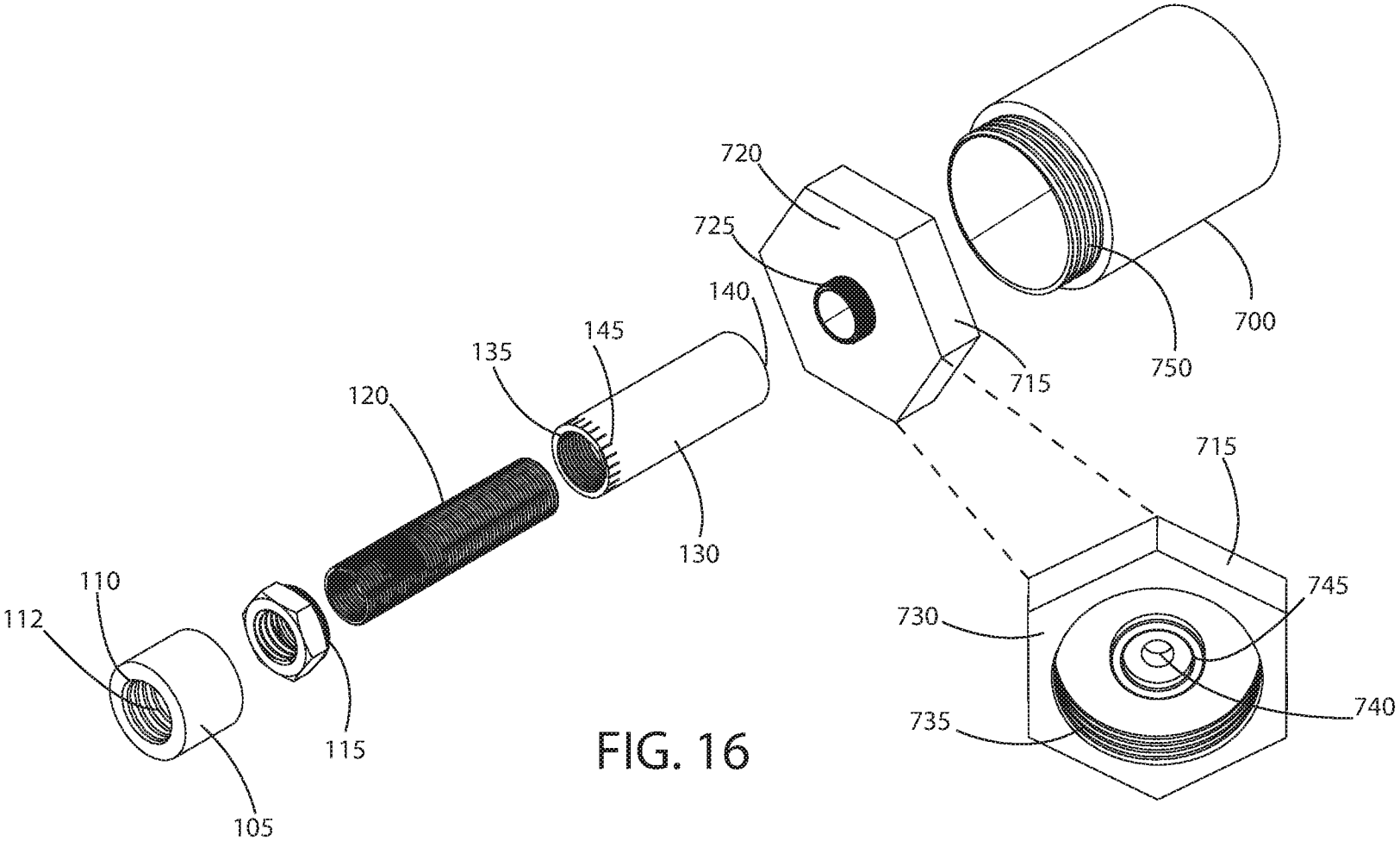
FIG. 16 is an exploded perspective view of the exemplary valve tip grinding tool of FIG. 15 with a magnet shaving catcher on the inside of the removable cap of the spring cup according to principles of the invention.
Figure 17:
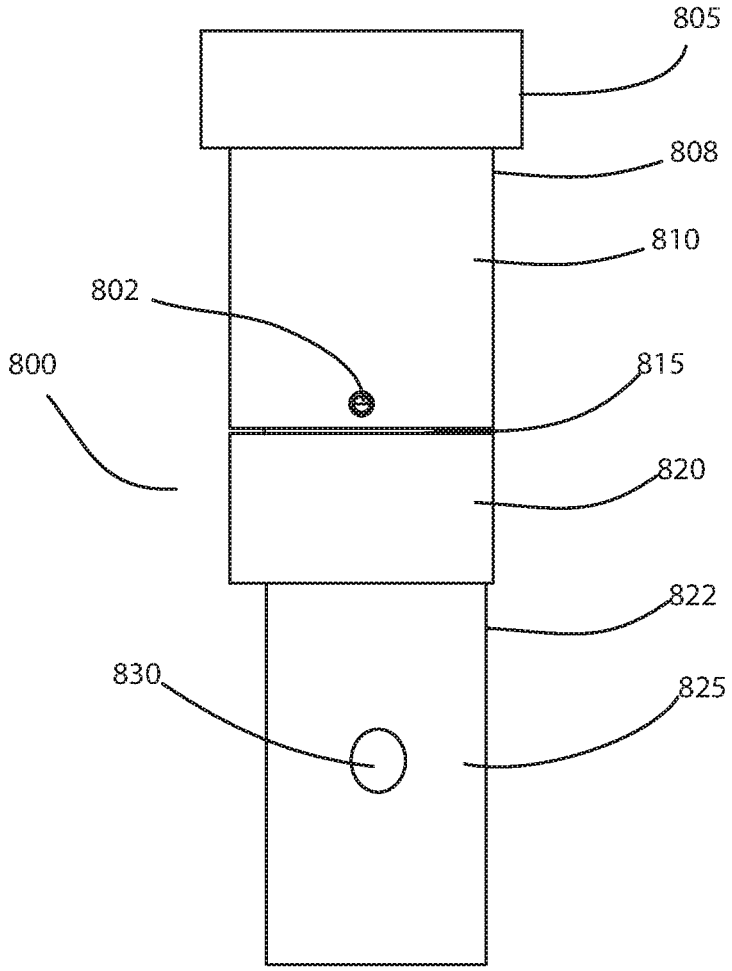
FIG. 17 is a front view of another exemplary valve tip grinding tool according to principles of the invention.
Figure 18:
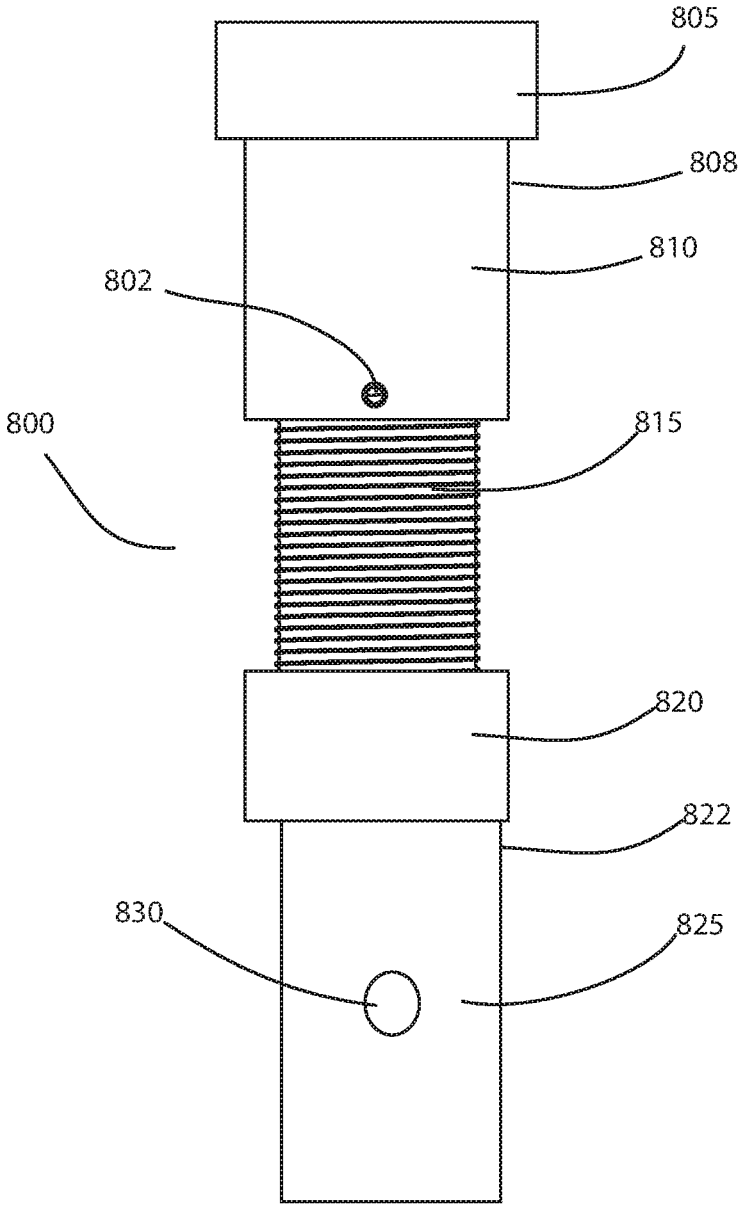
FIG. 18 is a front view of the exemplary valve tip grinding tool of FIG. 17 in an extended state according to principles of the invention.
Figure 19:
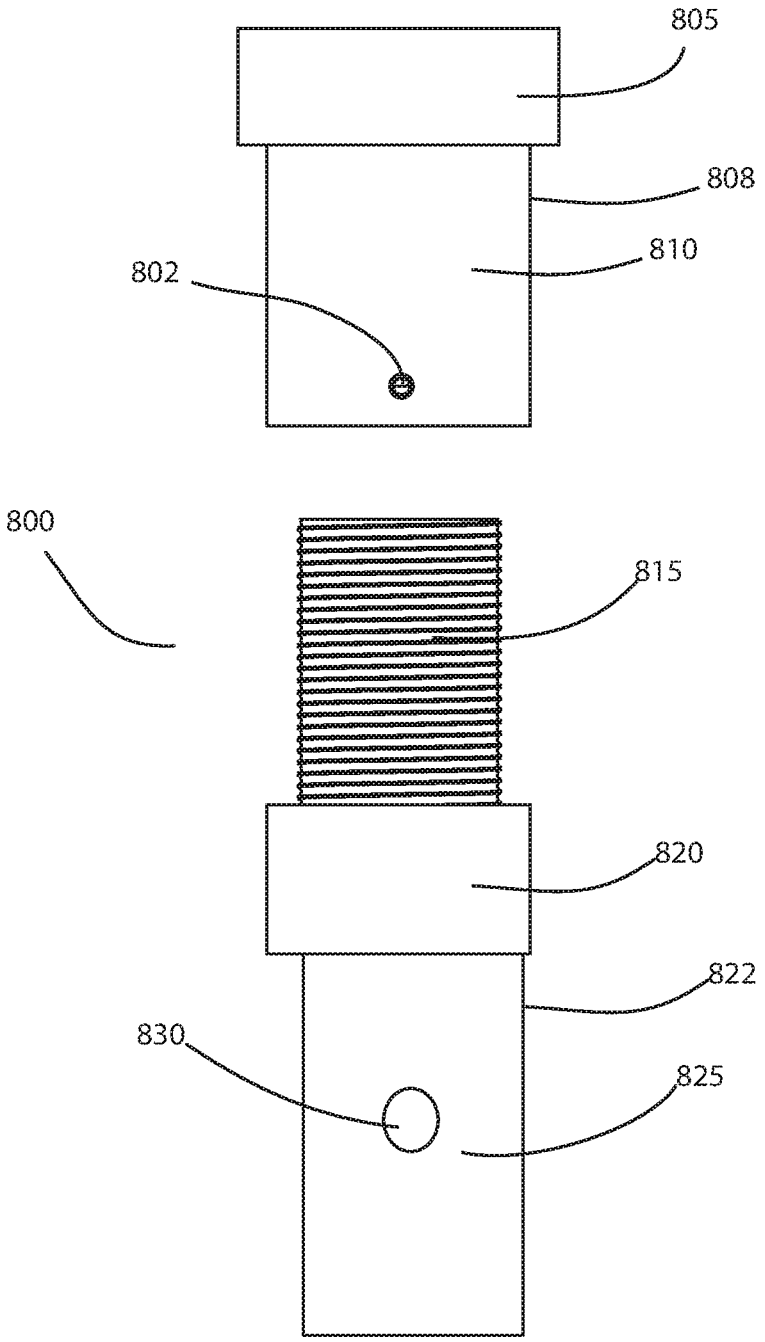
FIG. 19 is a front view of the exemplary valve tip grinding tool of FIG. 17 with the coupler removed according to principles of the invention.
Figure 20:
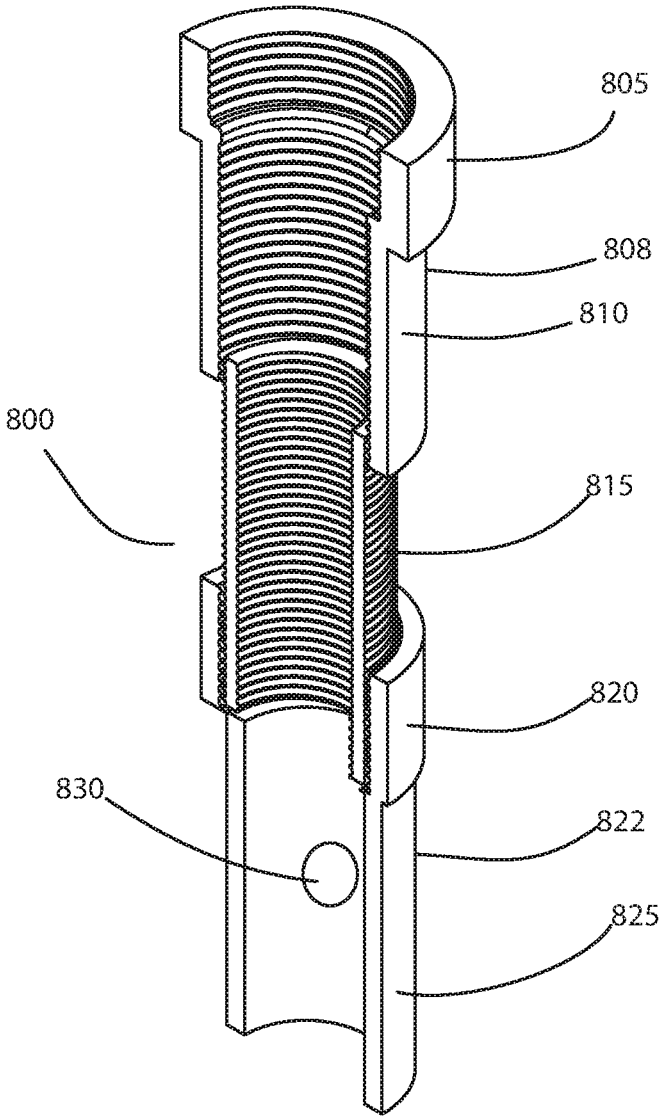
FIG. 20 is a perspective section view of the exemplary valve tip grinding tool of FIG. 17 in an extended state according to principles of the invention.

In the embodiment of FIGS. 15 and 16, the cup 160 is replaced with a cup 700 that includes a removable threaded cap 715. The cup 700 includes a male threaded top 750 that is received within the female threaded compartment 735 of the cap 715. The cap includes a male threaded collar 725 to thread into the end 140 of the outer adjustment sleeve 130. An aperture 740 is provided through the collar 725 to the interior of the cup 700. One or more magnets 745 is fastened (e.g., mechanically fastened or bonded) to the interior of the cap 715. The magnet catches steel shavings from the grinding process. In the exemplary embodiment, one ring-like magnet 745 concentric with the aperture 740 is shown. The removable cap 715 facilitates cleaning the caught shavings from the magnet after use. The cap 715 is shown with a hexagonal periphery that can be gripped with a wrench to facilitate installation and removal.

The magnet(s) 745 is (are) a permanent magnet, made from a material that is magnetized and creates its own persistent magnetic field. In an exemplary embodiment, each magnet is a ceramic, or ferrite, magnet made of a sintered composite of powdered iron oxide and barium/strontium carbonate ceramic; or an alnico magnet made by casting or sintering a combination of aluminum, nickel and cobalt with iron and other elements; or a rare-earth magnet, such as a samarium-cobalt or neodymium-iron-boron magnet. The magnet may be coated (e.g., nickel or zinc plated or epoxy coated) to enhance durability and corrosion resistance.

Referring now to FIGS. 17-20 an exemplary valve grinding tool 800 includes a coupler 808, a threaded sleeve 815 and an alignment tube 822. The coupler 808 includes a first end 805, a second end 810 and a coupler central channel extending from the first end of the coupler to the second end of the coupler. The first end 805 of the coupler 808 is open and includes internal threads for connecting to a rotary tool (e.g., to a threaded collar of such a tool). The second 810 end of the coupler 808 is open and opposite to the first end 805 of the coupler 810. A set screw 802 may be provided near the second end of the coupler 808 to secure the second end 810 of the coupler 805 to an end of the threaded sleeve 815.

The alignment tube 822 includes a first end 820, a second end 825 and an alignment tube channel extending from the first end 820 of the alignment tube to the second end 825 of the alignment tube. The alignment tube 822 has a central alignment tube longitudinal axis. The first end 820 of the alignment tube 822 is open and includes internal threads for connecting to the threaded sleeve 815. The second end 825 of the alignment tube 822 has an opening.

The threaded sleeve 815 includes a central channel. The threaded sleeve couples the second end 810 of the coupler 808 to the first end 820 of the alignment tube 822. A distance between the second end of the coupler and the first end of the alignment tube is adjustable by threadedly receiving a portion of the threaded sleeve 815 in the central channel of the coupler 808 and/or in the channel of the alignment tube 822. The central channel of the threaded sleeve 815 has a central longitudinal axis.

The opening of the second end 825 of the alignment tube 822 has a center. The central longitudinal axis of the threaded sleeve 855 is not aligned with the center of the opening of the second end 825 of the alignment tube 822. The opening of the second end 825 of the alignment 822 tube and the central channel of the alignment tube 822 are sized to receive an end (e.g., tip) of a stem of a valve to be ground. The coupler central channel and alignment tube channel are sized to receive a grinding disk attached to a shank.

In this embodiment, the valve grinding tool 800 is separate from from the stem of a valve to be ground. The valve stem may be inserted when ready for grinding. Also, in this embodiment, the valve grinding tool 800 is separate from the grinding disk attached to the shank. The grinding disk on the shank may be inserted when ready to commence grinding. Additionally, in this embodiment, the valve grinding tool is separate from the rotary tool. The rotary tool may be attached when ready for grinding.

The alignment tube channel includes a first portion and a second portion. The first portion extends from the first end 820 of the alignment tube 822 and has a first central longitudinal axis. The second portion extends from the second end 825 of the alignment tube 822 to the first portion of the alignment tube channel and has a second central longitudinal axis. The first central longitudinal axis is not aligned with the second central longitudinal axis.

In another embodiment, the alignment tube magnetically retains grindings. For example, at least one magnet 830 may be attached to (e.g., pressed into an aperture in) the alignment tube. Alternatively, the alignment tube may be comprised of a magnetized ferromagnetic material.

Figure 21:
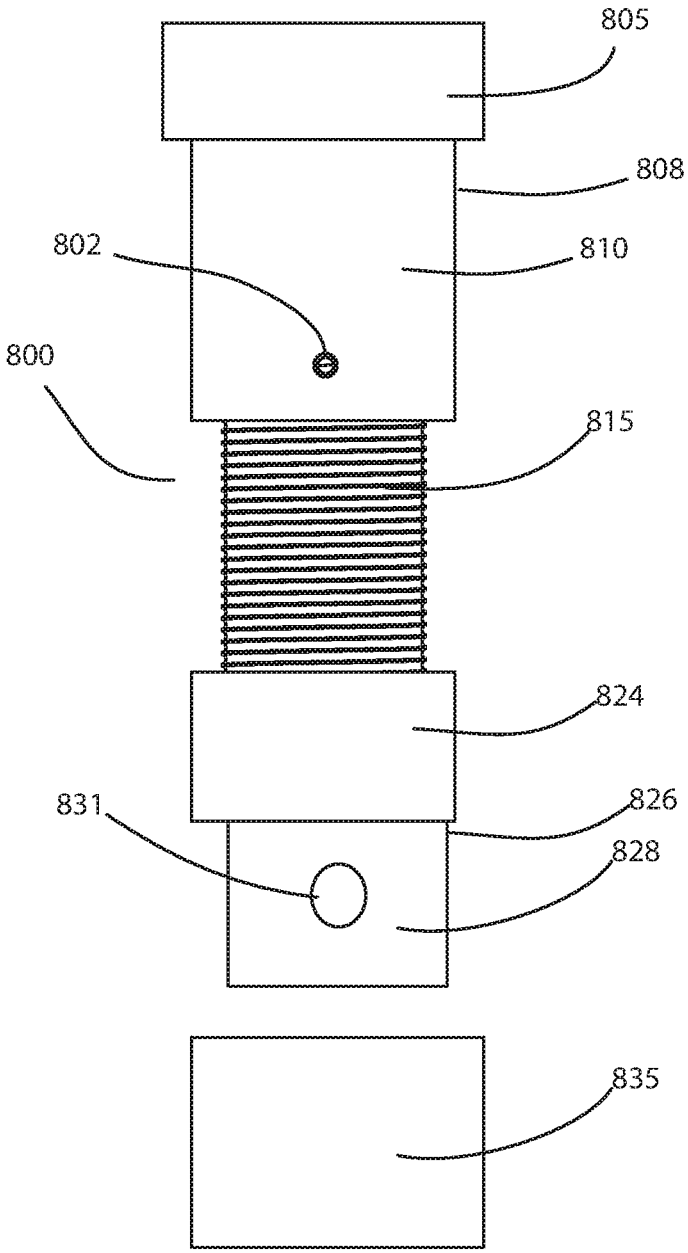
FIG. 21 is a front view of an exemplary grinding tool in an extended state with a cup-shaped cam follower according to principles of the invention; and Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

In another embodiment as shown in FIG. 21, the outer diameter of the alignment tube 826 is less (e.g., slightly less [no more than 2% less]) than an inner diameter of a cup-shaped cam follower 835 to be ground. In this embodiment, the disk of the grinding tool is positioned near the second end 828 of the alignment tube 826 and the cam follower cup 835 may be slid onto the end of the alignment tube 826 towards the first end 824 of the alignment tube 826. Thus, in this embodiment, the portion of the cam follower cup 835 that extends into the alignment tube 828 may be ground level.

In one embodiment, a rotary tool and grinding disk assembly are included to provided a valve grinding system. The rotary tool includes a motor, threaded collar and a chuck coupled to the motor. The grinding disk assembly includes an abrasive disk attached to a shank. The shank is retained in the chuck of the rotary tool. The alignment tube channel is sized to receive the abrasive disk attached to the shank of the grinding disk assembly.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A valve grinding system comprising:

a coupling, a threaded sleeve, an alignment tube, a rotary tool, and a grinding disk assembly, the rotary tool including a motor, threaded collar and a chuck coupled to the motor;

the grinding disk assembly including an abrasive disk attached to a shank, the shank being retained in the chuck of the rotary tool;

the coupling including a first end, a second end and a coupling central channel extending from the first end of the coupling to the second end of the coupling, the first end of the coupling being open and including internal threads for connecting to a rotary tool, the second end of the coupling being open and opposite to the first end of the coupling; and the alignment tube including a first end, a second end and an alignment tube channel extending from the first end of the alignment tube to the second end of the alignment tube and having a central alignment tube longitudinal axis, the first end of the alignment tube being open and including internal threads for connecting to the threaded sleeve;

the threaded sleeve including a central channel, and the threaded sleeve coupling the second end of the coupling to the first end of the alignment tube, a distance between the second end of the coupling and the first end of the alignment tube being adjustable by threadedly receiving a portion of the threaded sleeve in one of the central channel of the coupling and the channel of the alignment tube, and the central channel of the threaded sleeve having a central longitudinal axis; and the second end of the alignment tube and the central channel of the alignment tube being sized to receive an end of a stem of a valve to be ground, and the alignment tube channel being sized to receive the abrasive disk attached to the shank of the grinding disk assembly, the valve grinding system being separate from the valve and the stem of a valve to be ground.

2. The valve grinding system according to claim 1, wherein the alignment tube channel includes a first portion and a second portion, the first portion extending from the first end of the alignment tube and having a first central longitudinal axis, and the second portion extending from the second end of the alignment tube to the first portion of the alignment tube channel and having a second central longitudinal axis.

3. The valve grinding system according to claim 2, wherein the first central longitudinal axis is not aligned with the second central longitudinal axis.

4. The valve grinding system according to claim 1, further comprising at least one magnet attached to the alignment tube.

5. The valve grinding system according to claim 1, wherein the alignment tube is comprised of a magnetized ferromagnetic material.

* * * * *